United States Patent [19]

Brock

[11] 4,088,320

[45] May 9, 1978

[54] TENNIS RACKET ATTACHMENT

[76] Inventor: Joe F. Brock, 108 Kenwood Dr., Newburgh, Ind. 47630

[21] Appl. No.: 736,864

[22] Filed: Oct. 29, 1976

[51] Int. Cl.[2] ..... A63B 49/00

[52] U.S. Cl. ..... 273/73 R

[58] Field of Search ..... 273/73 R, 73 J, 162 E; 294/19 R, 19 A, 20

[56] References Cited

U.S. PATENT DOCUMENTS

| | | | |
|---|---|---|---|
| 1,540,823 | 6/1925 | Mairhofen | 273/73 R X |
| 2,556,701 | 6/1951 | Mozena | 294/20 |
| 2,681,822 | 6/1954 | Daniels | 294/20 |
| 3,989,247 | 11/1976 | Zimmerman | 273/73 R |

FOREIGN PATENT DOCUMENTS

| | | | |
|---|---|---|---|
| 799,947 | 8/1958 | United Kingdom | 273/73 R |
| 770,198 | 3/1957 | United Kingdom | 273/162 E |

*Primary Examiner*—Richard J. Apley

*Attorney, Agent, or Firm*—Warren D. Flackbert

[57] ABSTRACT

An attachment for a tennis racket characterized by a pair of resilient retaining members releasably positioned on the frame of the racket and arranged to receive a tennis ball resting on a court or other surface, and to raise such with upward movement of the racket for subsequent removal and use. With the ready grasping of a tennis ball, the tennis racket attachment eliminates, or at least minimizes, the countless bending and stooping formerly required for tennis ball retrieval during the course of a tennis game.

1 Claim, 3 Drawing Figures

TENNIS RACKET ATTACHMENT

The popularity of the game of tennis is widespread, reaching various age levels. A difficulty with the ordinary non-tournament type of play is the continual bending or stooping necessary to reach an unactive tennis ball so that play can be initiated or resumed. The retrieval problem presents a nuisance factor requiring energy which could be better expended in the usual playing of the tennis game.

The invention overcomes the preceding problem by providing an attachment releasably secured to a portion of the frame of the tennis racket. The attachment is defined by two resilient retaining members which, when the attachment is forced onto a tennis ball, grip the latter, and the tennis ball may then be raised for subsequent removal and use without the necessity of stooping or bending. In other words, the player merely directs the racket and the attachment downwardly onto the tennis ball, where the length of the tennis racket provides the necessary added length for tennis ball retrieval with either no or minimal bending effort.

The attachment of the invention is light in weight, not distracting from any balance requirements of the tennis racket during use. The attachment is releasably secured to the frame of the tennis racket, typically at the top center, or at either top quadrant, as viewed when the handle of the tennis racket is directed downwardly. The inner edges of the retaining members may include a series of gripping elements for even further tennis ball retaining.

Figure 1:
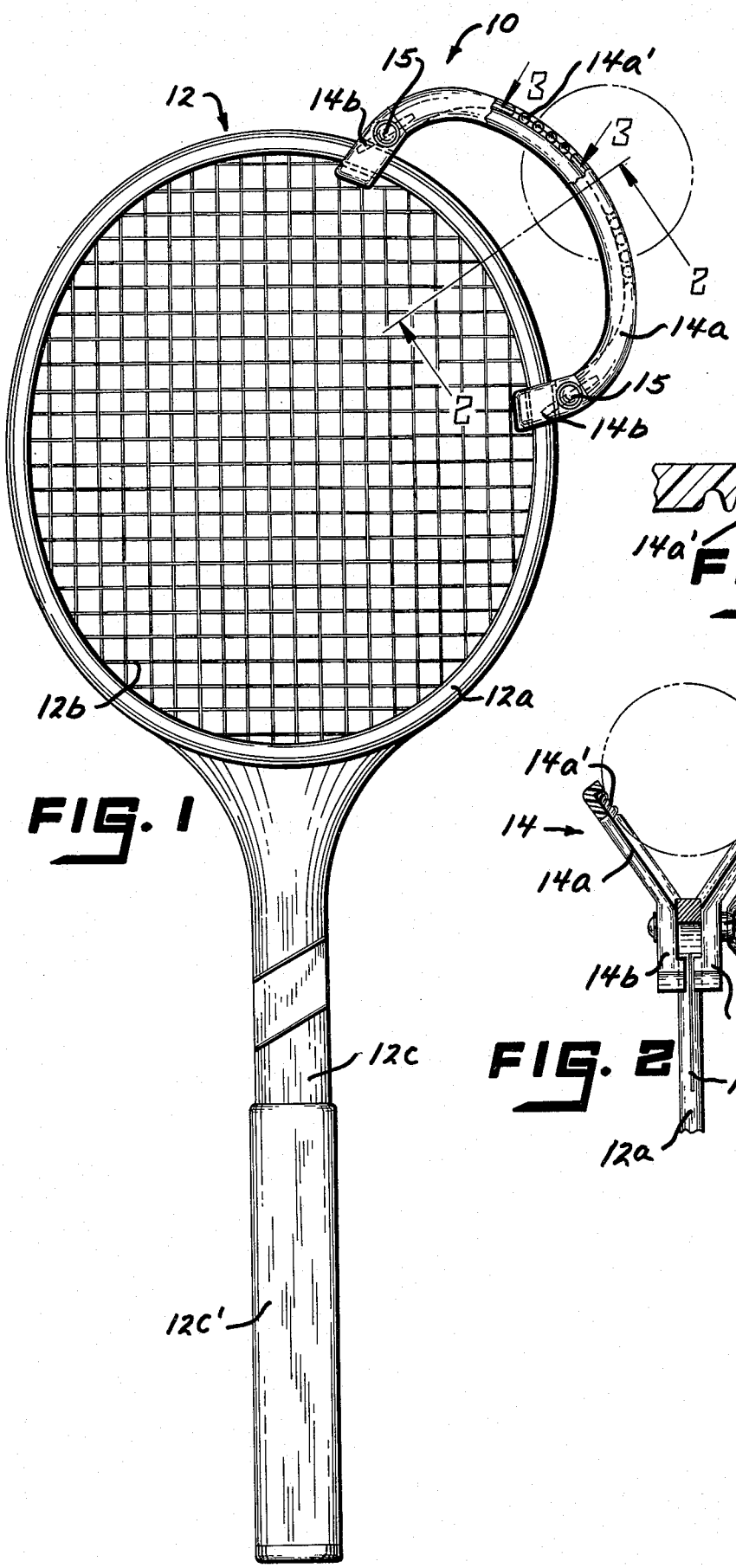
Figure 3:
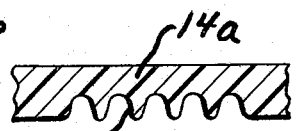
Figure 2:
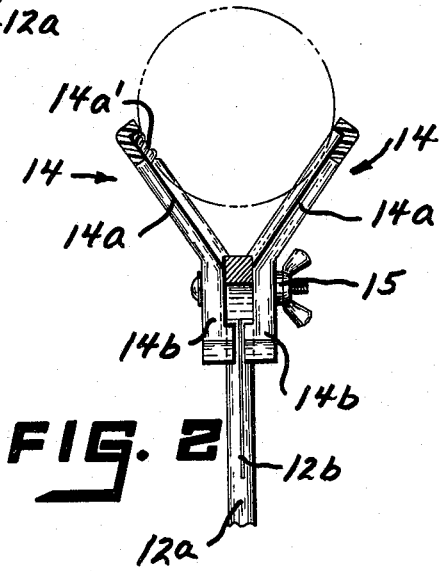

A better understanding of the present invention will become more apparent from the following description, taken in conjunction with the accompanying drawing, wherein FIG. 1 is a view of the front elevation showing the attachment of the invention positioned on a conventional tennis racket;

FIG. 2 is a view in section, taken at line 2—2 on FIG. 1 and looking in the direction of the arrows, showing further details of the instant tennis racket attachment; and, FIG. 3 is a further detailed view of the invention, in this instance taken at line 3—3 on FIG. 1 and looking in the direction of the arrows.

For the purposes of promoting an understanding of the principles of the invention, reference will now be made of the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the attachment 10 of the invention is shown in connection with a conventional tennis racket 12, where the latter is defined by a frame **12*a* surrounding a network of strings 12*b*. An elongated handle 12*c* forms part of the frame 12*a* and includes, typically, a handle grip 12*c*'. As is known, the frame 12*a* of the tennis racket 12** may be metal or wooden.

The attachment 10 is defined by two similar retaining members 14, each characterised by a curved central portion **14*a* terminating in a base portion 14*b* at opposite ends. As particularly evident in FIG. 2, the curved central portions 14*a* are inclined outwardly with respect to each other, and the base portions 14*b* are arranged to partially surround a portion of the frame 12*a*. In order to maintain the attachment 10 on the tennis racket, fastening means 15, such as a wing nut and bolt, are provided between the base portions 14*b* of adjacent retaining members 14**.

In a preferred form of the invention, the inner surfaces of the curved central portions **14*a* of the retaining members 14 are defined by contact points 14*a*', as knobs, projections or cut-out fingers (see FIGS. 2 and 3). As a matter of material choice, the attachment 10** is molded from a resilient high impact plastic, such as resins of the IONOMER, ACETAL or ABS families, for example. In any event, a lightweight finished unit is achieved which does not affect the playing characteristics of the tennis racket during use.

The attachment 10 is fastened onto the frame **12*a* of the tennis racket 12 at an upper quadrant (as shown in FIG. 1) or at the top of the tennis racket (not shown). As the tennis racket 12 is held in the player's hand, and as the player approaches a tennis ball laying on the court's surface, the tennis racket 12 is moved downwardly and the tennis ball (shown in phantom) caused to assume the position of FIG. 2, i.e. in an urged relationship between the retaining members 14. The tennis racket 12** is then raised and the tennis ball readily removed for further use in the game.

It should be evident, therefore, that the invention provides a ready arrangement for retrieving a tennis ball with minimal stooping or bending on the part of the user. The attachment is light in weight and readily positioned at any desired location on the racket through the release and tightening of the wing nut and bolts defining the fastening means 15.

In any event, the described attachment is susceptible to various changes within the spirit of the invention, as, for example in material, proportioning and, of course, the particular fastening employed. Thus, the above should be considered illustrative and not as limiting the scope of the following claims:

I claim:

1. The combination of a tennis racket having a frame surrounding a string area and an attachment selectively secured to said frame, where the attachment comprises a first and a second resilient retaining member extending along the upper portion of said frame in a side-by-side relationship, said retaining members angling outwardly with respect to each other and to said frame and each having a base portion disposed on opposite sides of said frame, fastening means releasably assembling said base portions together on said frame, and a series of contacts on the inner surfaces of said retaining members selectively gripping a tennis ball.

* * * * *